US006884951B1

(12) United States Patent
Wong

(10) Patent No.: US 6,884,951 B1
(45) Date of Patent: Apr. 26, 2005

(54) FLUID-BASED SWITCHES AND METHODS FOR MANUFACTURING AND SEALING FLUID-BASED SWITCHES

(75) Inventor: Marvin Glenn Wong, Woodland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 20 days.

(21) Appl. No.: 10/696,641

(22) Filed: Oct. 29, 2003

(51) Int. Cl.[7] ..... H01H 29/00
(52) U.S. Cl. ..... 200/182
(58) Field of Search ..... 200/182, 187–189, 200/209–219, 233–236; 310/328, 331, 348, 363; 335/4, 47, 78; 385/19

(56) References Cited

U.S. PATENT DOCUMENTS 3,955,059 A * 5/1976 Graf ..... 200/181
6,646,527 B1 * 11/2003 Dove et al. ..... 335/47
6,647,165 B2 * 11/2003 Hu et al. ..... 385/16
6,759,611 B1 7/2004 Wong et al.

* cited by examiner

*Primary Examiner*—Michael A. Friedhofer
(74) *Attorney, Agent, or Firm*—Cynthia S. Mitchell

(57) ABSTRACT

Fluid-based switches and methods for producing the same are disclosed. In one embodiment, a method for producing a switch comprises depositing a first alignment pad on a first substrate, depositing a second alignment pad on a second substrate with a perimeter relief surrounding the second alignment pad, depositing solder on at least one of the alignment pads, depositing a switching fluid on the first substrate, mating the first substrate to the second substrate by aligning the alignment pads and heating the solder, the substrates defining there between a cavity holding the switching fluid, the cavity being sized to allow movement of the switching fluid between first and second states to form a liquid switch, forming a perimeter ring around the liquid switch on at least one of the two substrates, depositing wettable material in the perimeter ring, depositing solder paste containing uncured epoxy on the wettable material in the perimeter ring, and reflowing the solder paste.

15 Claims, 7 Drawing Sheets

FLUID-BASED SWITCHES AND METHODS FOR MANUFACTURING AND SEALING FLUID-BASED SWITCHES

BACKGROUND OF THE INVENTION

Fluid-based switches, such as liquid metal micro switches (LIMMS) have been made that use a liquid metal, such as mercury, as the switching element. The liquid metal may make and break electrical contacts. Alternately, a LIMMS may use an opaque liquid to open or block light paths. To change the state of the switch, a force is applied to the switching fluid, which causes it to change form and move.

Substrates used to manufacture the LIMMS may be held together with adhesives, such as polymers or thermoplastic perfluorocarbon material. The adhesives used may not withstand some assembly conditions (e.g., soldering temperatures). The adhesives may break down and release harmful products at elevated temperatures, which may occur during manufacturing or use. Elevated temperature cycles may inject harmful gases into the LIMMS channels, which may cause corrosion to liquid metal or the substrate. This corrosion may also create gas bubbles in the adhesive material, which may weaken the bond holding the channel plate to the substrate. The liquid metal may escape by vapor phase diffusion using the bubbles as a high permeability leak path through the adhesive material. If the liquid metal is mercury, this may cause negative environmental and health problems. Additionally, if a bubble-type leak path is present, environmental gases may rapidly diffuse into the interior of the switch and cause corrosion of the liquid metal or other internal structures.

Additionally, polymers may absorb gases and/or moisture and may outgas during use, which may cause chemical contamination of the interiors of the package. Polymers also do not seal hermetically, so additional sealing is required to create a hermetic switch.

SUMMARY OF THE INVENTION

In one embodiment, a method for producing a switch is disclosed. The method comprises depositing a first alignment pad on a first substrate. A second alignment pad is deposited on a second substrate. The second alignment pad includes a perimeter relief. A perimeter ring is formed around the switching device and solderable material is deposited in the perimeter ring. Solder is then deposited on at least one of the alignment pads. A switching fluid is also deposited on the first substrate. The substrates are mated together by aligning the alignment pads and heating the solder. Excess solder is squeezed into the recess created by the perimeter relief around the second alignment pad on the second substrate. A cavity holding the switching fluid is defined between the two substrates, the cavity sized to allow movement of the switching fluid between first and second states. A solder paste containing uncured epoxy is deposited in the perimeter ring and heated, wetting the pads and excluding and curing the epoxy.

BRIEF DESCRIPTION OF THE DRAWINGS

Illustrative embodiments of the invention are illustrated in the drawings in which.

DETAILED DESCRIPTION

Figure 1:
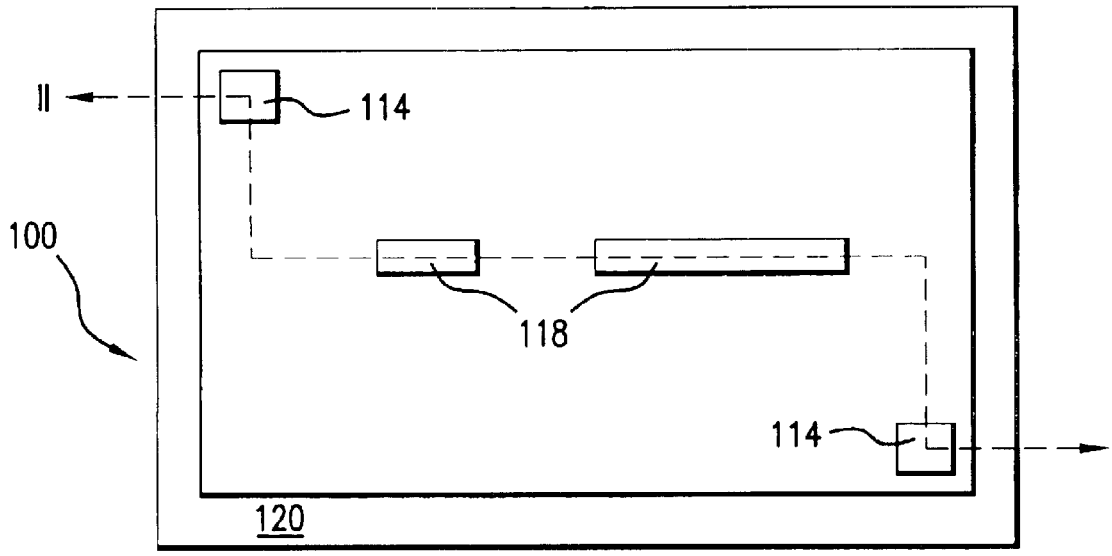
FIG. 1 illustrates an exemplary plan view of a substrate including switching fluid and alignment pads.
Figure 2:
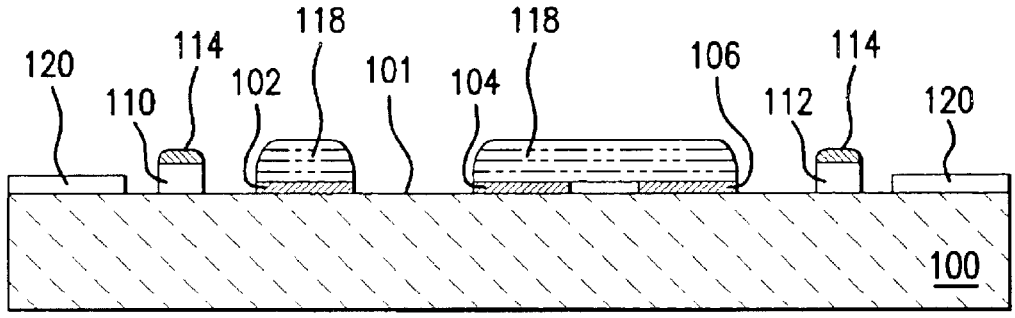
FIG. 2 is an elevation view of the substrate shown in FIG. 1.

FIGS. 1 and 2 illustrate a first substrate 100 for a fluid-based switch, such as a LIMMS. By way of example, the first substrate 100 may be ceramic, glass, ceramic-coated metal, or a combination of these materials. Other suitable materials may also be used. Surface 101 of substrate 100 may be optically flat to enable intimate contact of substrate 100 surface 101 with the mating surface 301 of the mating part 300.

Deposited on the substrate 100 are pluralities of wettable pads 102, 104, 106, possibly serving as electrical contacts. Switching fluid 118 is deposited on the wettable pads 102–106. Switching fluid 118 may be a liquid metal, such as mercury, and may be used to make and break electrical contacts or open and block light paths.

Also deposited on the substrate 100 are alignment pads 110, 112. Alignment pads 110, 112 may be made of a wettable material, such as metal or metal alloys, and may be used to align and mate substrate 100 with a second substrate used to form a switch. It should be appreciated that alternate embodiments may include a different number of alignment pads 110, 112 and/or wettable pads 102, 104, 106 than that depicted in FIGS. 1 and 2.

Solder 114 is deposited on each alignment pad 110, 112. By way of example, solder 114 may be a solder with a high-melting point. Solder 114 may be used to mate the first substrate 100 to a second substrate used in the formation of the switch. In alternate embodiments, solder 114 may alternately or additionally be deposited on alignment pads located on the second substrate.

Seal ring 120 is deposited on at least a portion of the perimeter of the first substrate 100. By way of example, seal ring 120 may be made of a wettable material, such as metal or metal alloys. As will be described in further detail below, seal ring 120 may be used to hermetically seal the switch. Sealing ring 120 may not be included in alternate embodiments.

Figure 3:
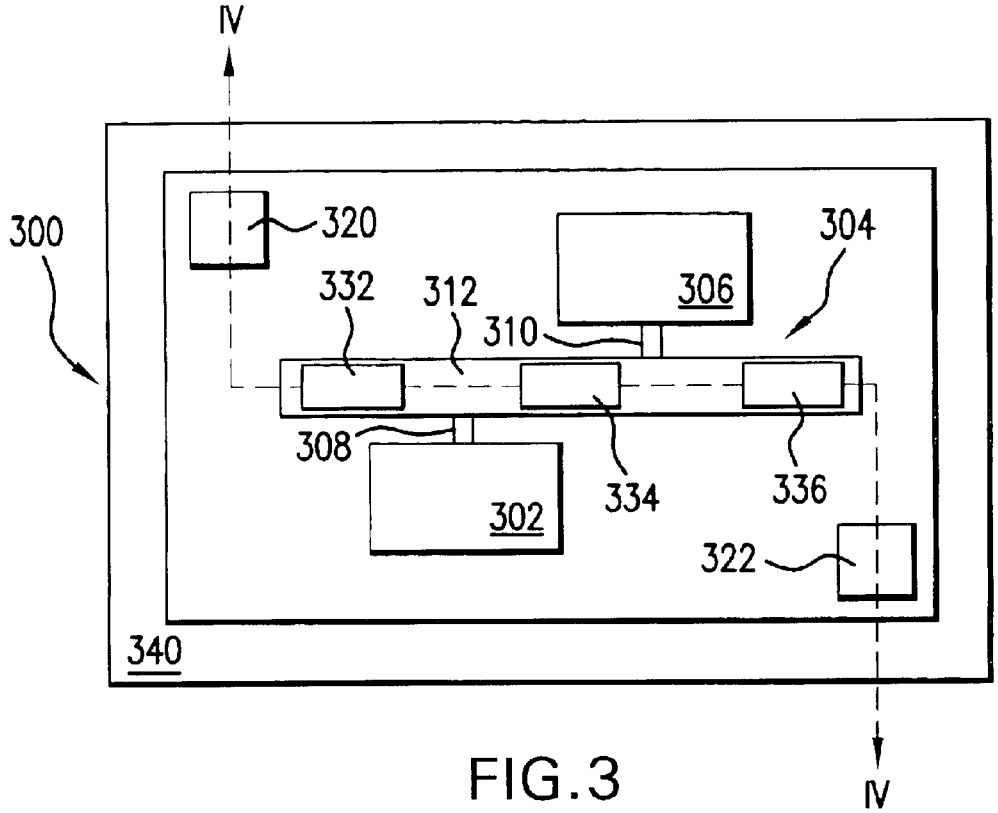
FIG. 3 illustrates an exemplary plan view of a substrate including a switching fluid channel and alignment pads.
Figure 4:
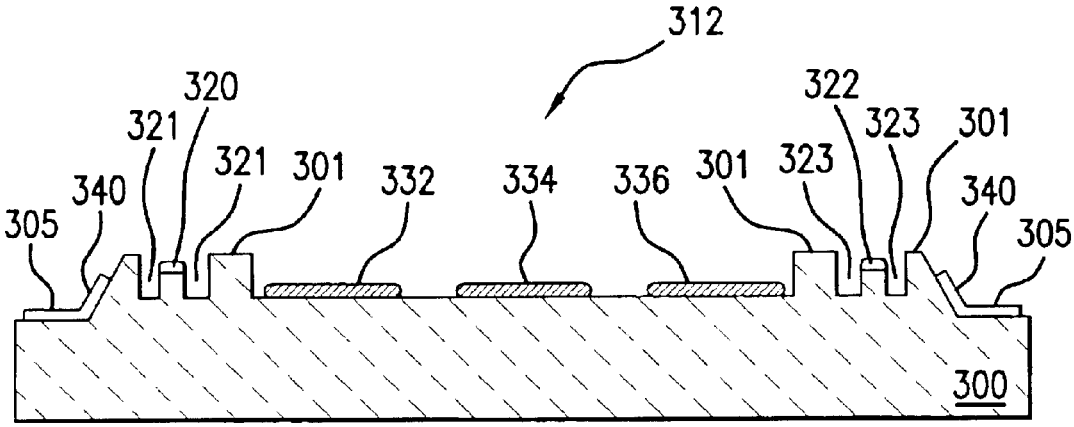
FIG. 4 is an elevation view of the substrate shown in FIG. 3.

FIGS. 3 and 4 illustrate a second substrate 300 used in a fluid based-switch. Surface 301 of substrate 300 may be optically flat to aid in creating intimate contact of substrate 300 surface 301 with the mating surface 101 of substrate 100. The second substrate 300 includes a switching fluid channel 304, a pair of actuating fluid channels 302, 306, and a pair of channels 308, 310 that connect corresponding ones of the actuating fluid channels 302, 306 to the switching fluid channel 304. It is envisioned that more or fewer channels may be formed in the substrate 300, depending on the configuration of the switch in which the substrate is to be used. For example, the pair of actuating fluid channels 302, 306 and pair of connecting channels 308, 310 may be replaced by a single actuating fluid channel and single connecting channel. Additionally, it is envisioned that in alternate embodiments, channels or portions of channels may be formed in the first substrate 100 used to construct the switch.

In some embodiments, substrate 300 may comprise multiple layers that are used to form the channels of the substrate 300. The layers may provide a gap between seal rings 120, 340 for solder to flow into to hermetically seal the switch. The layers may also provide better control of cavity volumes during manufacturing. By way of example, the layers may be glass, ceramic, ceramic-coated metal, a combination of these materials, or other suitable materials. The layers of the substrate 300 may be assembled together by anodically bonding or fusion bonding them together. This may provide a more robust bond able to withstand other assembly conditions, such as soldering, and may reduce or eliminate the risk of chemical contamination. However, in alternate embodiments using multiple layers, adhesives or other bonding methods may also be used.

The substrate 300 also includes seal ring 340 deposited on at least a portion of a perimeter ring 305 formed on the substrate 300. By way of example, seal ring 340 may be made of a wettable material, such as metal or metal alloys. Seal ring 340 should not extend to surface 301. As will be described in further detail below, seal ring 340 may be used to hermetically seal the switch. It should be appreciated that in alternate embodiments, substrate 300 may not include seal ring 340.

Substrate 300 further includes alignment pads 320, 322. Alignment pads 320, 322 may be made of a wettable material, such as metal or metal alloys, and may be used to align and mate substrate 300 with a first substrate 100 to form a switch. Alignment pads 320 and 322 may be deposited on a raised area within a perimeter relief 321 and 323 to form a perimeter trench around the alignment pads 320 and 322. It should be appreciated that alternate embodiments may include a different number of alignment pads. It should also be appreciated that solder 114 may alternately, or additionally, be deposited on one or more of the alignment pads 320, 322 on the second substrate 300.

Seal belts 332, 334, 336 may also optionally be deposited on substrate 300. They may be made of a wettable material, such as metal or metal alloys. The use of seal belts within a switching fluid channel 304 may provide additional surface areas to which a switching fluid may wet. This not only helps in latching the various states that a switching fluid can assume, but also helps to create a sealed chamber from which the switching fluid cannot escape, and within which the switching fluid may be more easily pumped (i.e., during switch state changes). It should be appreciated that alternate embodiments may not include seal belts 332–336.

Figure 5:
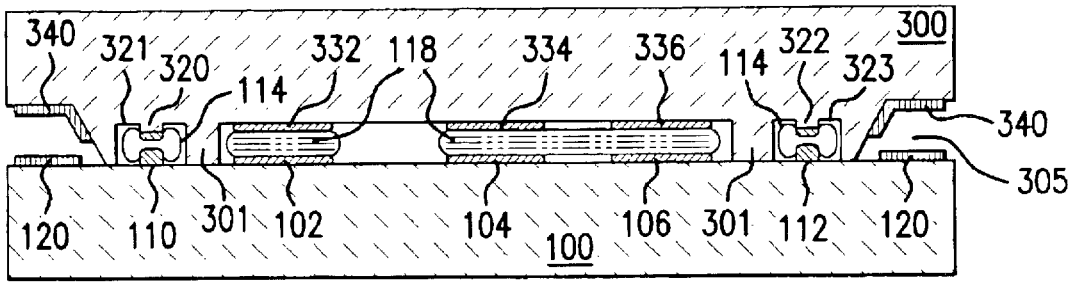
FIG. 5 illustrates an elevation view of the substrates shown in FIGS. 1–4 soldered together to form a switch.
Figure 8A:
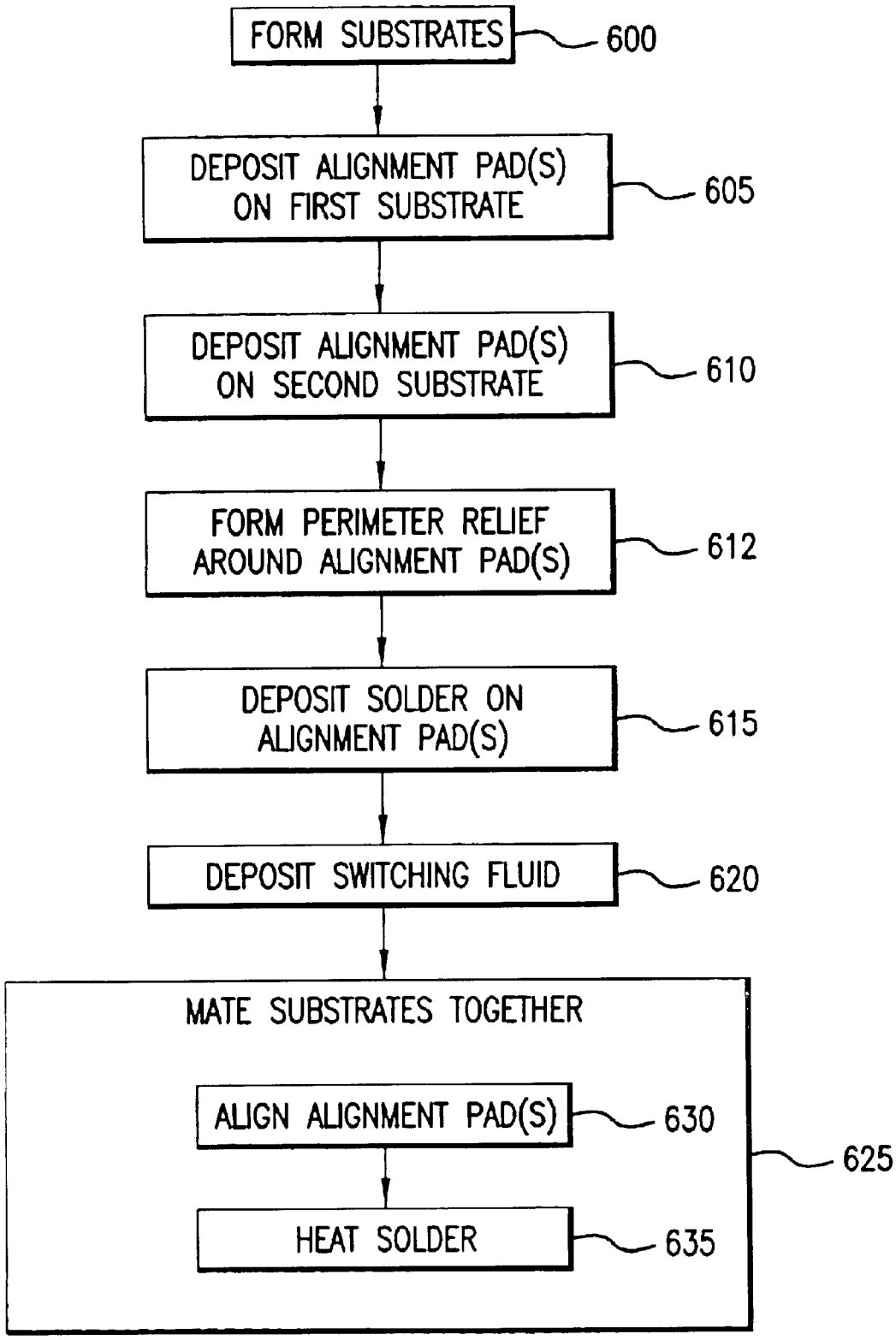
FIG. 8A illustrates a first method of forming the switch of FIGS. 1–7.

FIG. 5 illustrates a fluid-based switch that may be formed by soldering together substrates 100, 300. As illustrated by FIG. 8A, the switch may be made by forming 600 at least two substrates 100, 300, so that the substrates mated together define between them portions of a number of cavities. Each substrate may include a seal ring 120, 340 deposited on a portion of the perimeter of the substrate that may be used to hermetically seal the switch. In alternate embodiments, seal rings 120, 340 may not be included.

Next, alignment pads 110, 112 are deposited 605 on the first substrate and alignment pads 320, 322 are deposited 610 on the second substrate. Perimeter relief trench 321 and 323 is formed 612 around alignment pads 320 and 322. Solder 114 is deposited 615 on at least one of the alignment pads 110, 112, 320, 322. Additionally, switching fluid 118 is deposited 620 on one of the substrates 100. It should be appreciated that the switching fluid 118 and the alignment pads 110, 112, 320, 322 may be deposited in any order. In alternate embodiments, before depositing switching fluid 118 or alignment pads 110, 112 on the substrates 100, 300, one or both of the substrates may be made optically flat and smooth (e.g., by lapping, polishing, or chemical mechanical polishing) to aid in the intimate contact of the substrates.

Finally, the first substrate 100 is mated 625 to the second substrate 300 by aligning 630 their respective alignment pads 110/320, 112/322, and heating 635 the solder 114. Excess solder is squeezed into the relief trench 321 and 323 around the contact pads during the mating. The substrates 100, 300 may be brought into close contact with each other by pressing the substrates together during the heating of the solder 114, which may improve switch performance by minimizing leakage of gases and/or liquids passing between the substrates. It should be appreciated, that by using an adhesive-free method to bond the substrates together and create the switch, the risk of chemical contamination to the interior of the switch may be reduced or eliminated. Additionally, the solder 114 may be better able to withstand other assembly conditions and heat fluctuations.

Figure 6:
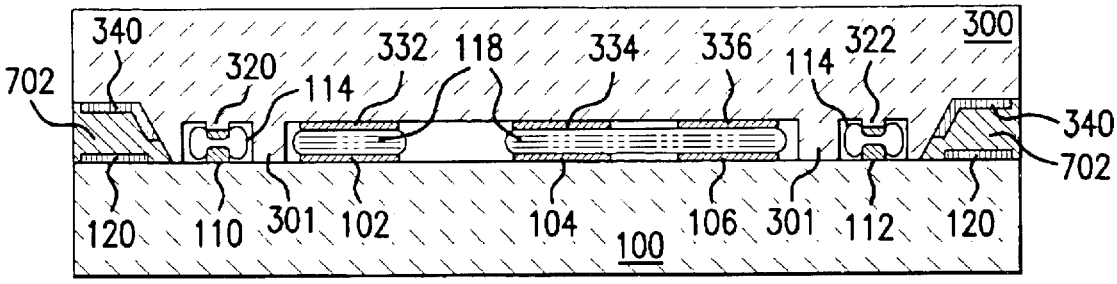
FIG. 6 illustrates an elevation view of a second exemplary embodiment of the switch shown in FIG. 5 with solder deposited in a perimeter ring.
Figure 7:
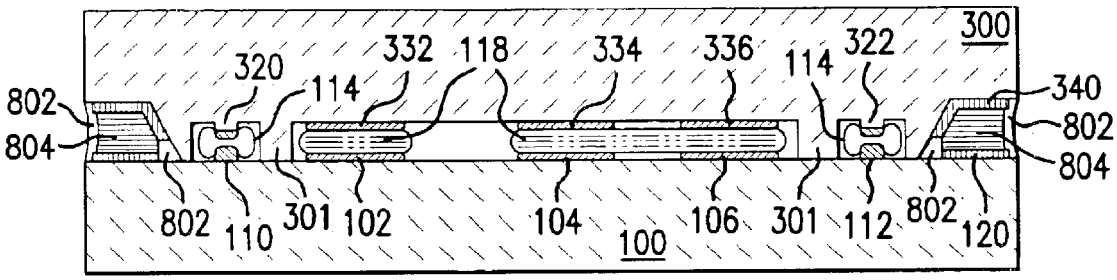
FIG. 7 illustrates an elevation view of the switch of FIG. 6 after heating.
Figure 8B:
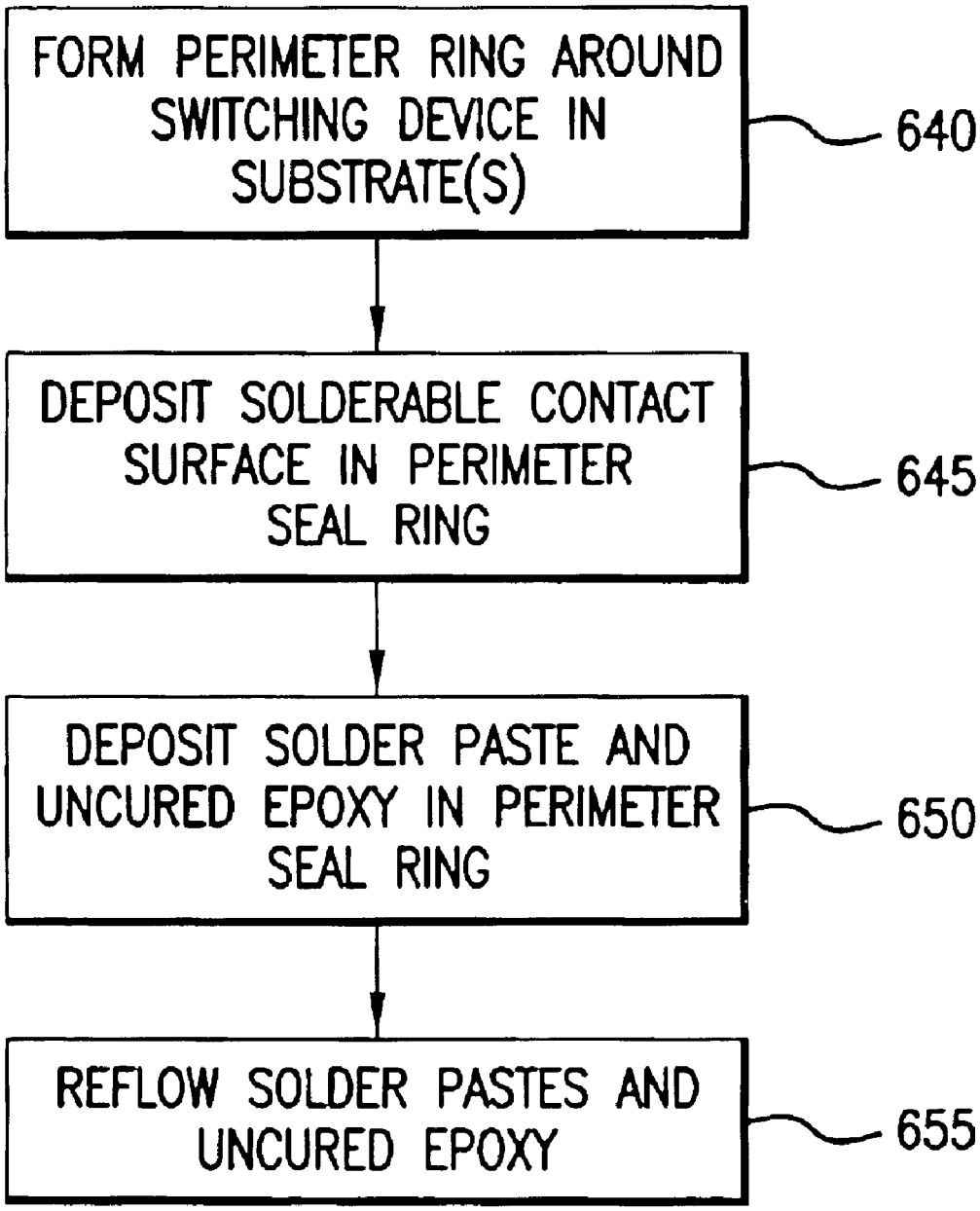
FIG. 8B illustrates a second method of forming the switch of FIGS. 1–7.

FIGS. 6 and 7 illustrate a second exemplary embodiment of a switch that is hermetically sealed. The switch comprises substrates 100, 300 mated together so that portions of a number of cavities are defined between the substrates. As illustrated in FIG. 8B, either or both substrates may have a perimeter ring 305 formed 640 around the switching device. Each substrate 100, 300 includes a solderable contact surface or seal ring 120, 340 deposited 645 on a portion of the perimeter ring 305 of the respective substrate. Alternatively, this step may occur between 610 and 612. By way of example, seal rings 120, 340 may be a wettable material, such as metal or metal alloys. Substrate 300 further includes seal belts 332, 334, 336 to provide additional surface area for switching fluid 118 to wet. Alternate embodiments may not include seal belts 332–336.

The substrates 100, 300 may be soldered 114 together as previously described with reference to FIG. 8A. A hermetic seal may then be created by dispensing 650 a solder paste with uncured epoxy 702 on at least one of the substrates. The solder paste may then be heated 655 to wet the solder 804 to the seal rings 120, 340 and create the hermetic seal. The solder 804 will tend to go to into the center due to surface tension and wetting effects of seal rings 120 and 340, ensuring the seal if the surfaces are wettable and there is enough solder. The polymeric seal material 802 from the epoxy will be excluded from the solder 804 to the inner and outer perimeters of the perimeter seal ring 305.

In one embodiment, solder 114 used to assemble the substrates may have a higher melting point than the solder 804 used to create the hermetic seal, which may prevent the solder 114 from melting during the creating of the hermetic seal. Epoxy flux 802 surrounds at least a portion of the solder 804 and may protect the solder from vapors created by the switching fluid 118. It should be appreciated that alternate embodiments may not include epoxy flux 802.

Figure 9:
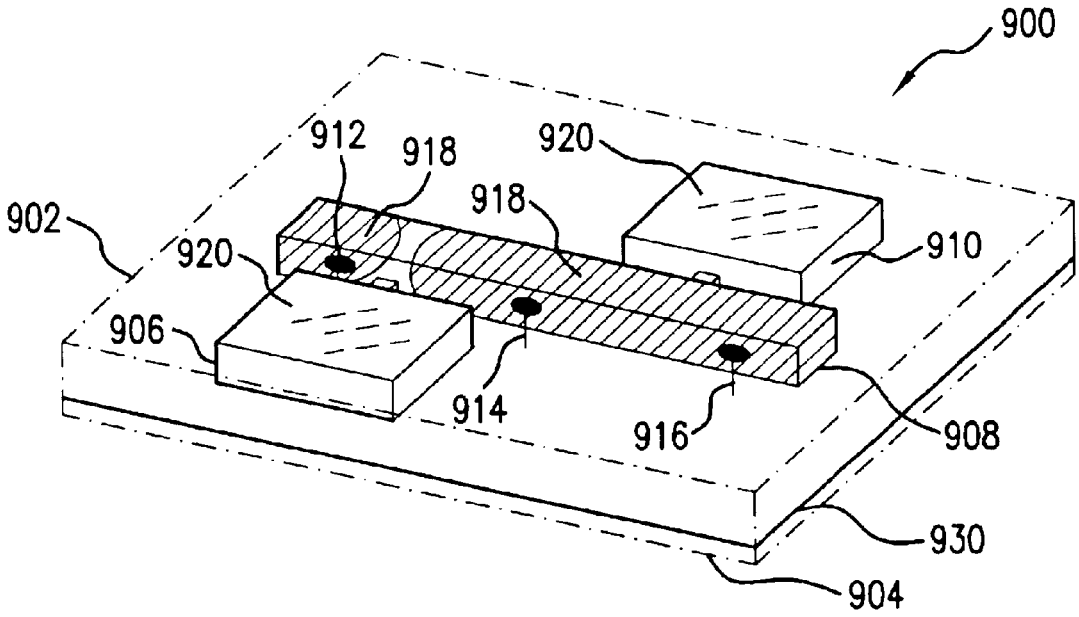
FIG. 9 illustrates a perspective view of a first exemplary embodiment of a hermetically sealed switch.

FIG. 9 illustrates a first exemplary embodiment of a fluid-based switch including a hermetic seal 930. The switch 900 comprises a first substrate 902 and a second substrate 904 mated together. Substrates 902, 904 may be soldered together as described previously in this application. The switch may then be hermetically sealed as described with reference to FIGS. 6–8. By using an adhesive-free method to assemble the substrates, the risk of chemical contamination to the interior of the switch may be reduced or eliminated. It should be appreciated that in alternate embodiments, the switch 900 may not include the hermetic seal 930.

The substrates 902 and 904 define between them a number of cavities 906, 908, and 910. Exposed within one or more of the cavities are a plurality of electrodes 912, 914, 916. A switching fluid 918 (e.g., a conductive liquid metal such as mercury) held within one or more of the cavities serves to open and close at least a pair of the plurality of electrodes 912–916 in response to forces that are applied to the switching fluid 918. An actuating fluid 920 (e.g., an inert gas or liquid) held within one or more of the cavities serves to apply the forces to the switching fluid 918.

In one embodiment of the switch 900, the forces applied to the switching fluid 918 result from pressure changes in the actuating fluid 920. The pressure changes in the actuating fluid 920 impart pressure changes to the switching fluid 918, and thereby cause the switching fluid 918 to change form, move, part, etc. In FIG. 9, the pressure of the actuating fluid 920 held in cavity 906 applies a force to part the switching fluid 918 as illustrated. In this state, the rightmost pair of electrodes 914, 916 of the switch 900 are coupled to one another. If the pressure of the actuating fluid 920 held in cavity 906 is relieved, and the pressure of the actuating fluid 920 held in cavity 910 is increased, the switching fluid 918 can be forced to part and merge so that electrodes 914 and 916 are decoupled and electrodes 912 and 914 are coupled.

By way of example, pressure changes in the actuating fluid 920 may be achieved by means of heating the actuating fluid 920, or by means of piezoelectric pumping. The former is described in U.S. Pat. No. 6,323,447 of Kondoh et al. entitled "Electrical Contact Breaker Switch, Integrated Electrical Contact Breaker Switch, and Electrical Contact Switching Method", which is hereby incorporated by reference for all that it discloses. The latter is described in U.S. patent application Ser. No. 10/137,691 of Marvin Glenn Wong filed May 2, 2002 and entitled "A Piezoelectrically Actuated Liquid Metal Switch", which is also incorporated by reference for all that it discloses. Although the above referenced patent and patent application disclose the movement of a switching fluid by means of dual push/pull actuating fluid cavities, a single push/pull actuating fluid cavity might suffice if significant enough push/pull pressure changes could be imparted to a switching fluid from such a cavity. Additional details concerning the construction and operation of a switch such as that which is illustrated in FIG. 9 may be found in the afore-mentioned patent of Kondoh.

Figure 10:
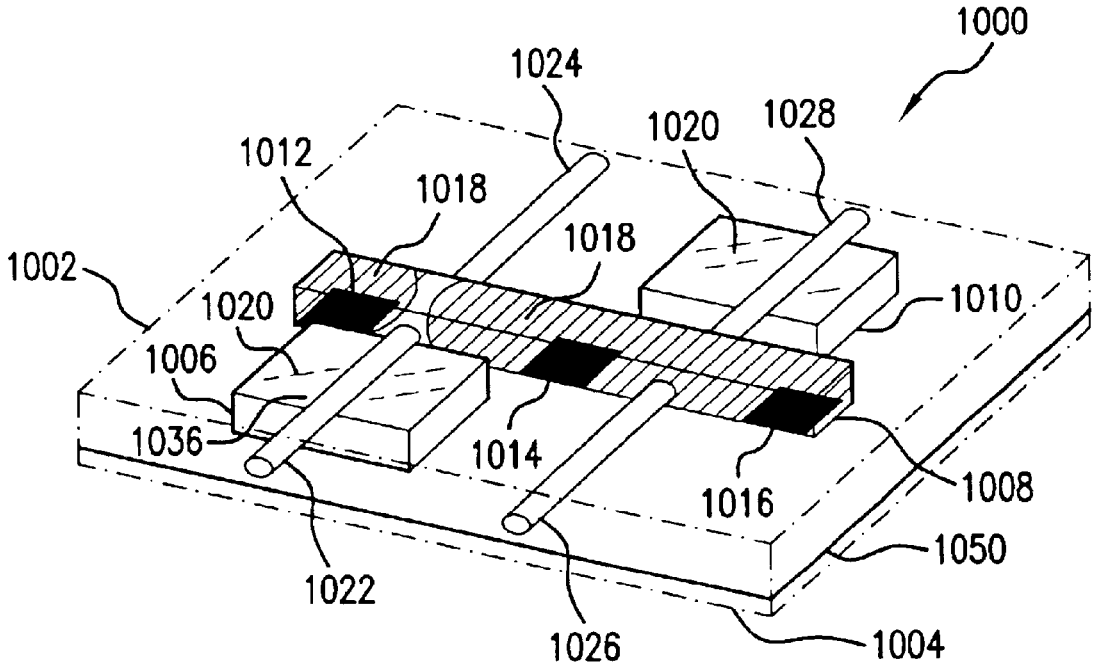
FIG. 10 illustrates a perspective view of a second exemplary embodiment of a hermetically sealed switch.

FIG. 10 illustrates a second exemplary embodiment of a switch 1000. The switch 1000 comprises a substrate 1002 and a second substrate 1004 mated together. Substrates 1002, 1004 may be soldered together as previously described. Switch 1000 may then be hermetically sealed as described with reference to FIGS. 6–8. In alternate embodiments, switch 1000 may not include hermetic seal 930. It should be appreciated that by using an adhesive-free method to assemble the substrates, the risk of chemical contamination to the interior of the switch 1000 may be reduced or eliminated and the bonding between the substrates 902, 904 may be better able to withstand other assembly or operating conditions than adhesives.

The substrates 1002 and 1004 define between them a number of cavities 1006, 1008, 1010. Exposed within one or more of the cavities are a plurality of wettable pads 1012–1016. A switching fluid 1018 (e.g., a liquid metal such as mercury) is wettable to the pads 1012–1016 and is held within one or more of the cavities. The switching fluid 1018 serves to open and block light paths 1022/1024, 1026/1028 through one or more of the cavities, in response to forces that are applied to the switching fluid 1018. By way of example, the light paths may be defined by waveguides 1022–1028 that are aligned with translucent windows in the cavity 1008 holding the switching fluid. Blocking of the light paths 1022/1024, 1026/1028 may be achieved by virtue of the switching fluid 1018 being opaque. An actuating fluid 1020 (e.g., an inert gas or liquid) held within one or more of the cavities serves to apply the forces to the switching fluid 1018.

Additional details concerning, the construction and operation of a switch such as that which is illustrated in FIG. 10 may be found in the aforementioned patent of Kondoh et al., and patent application of Marvin Wong. Other switch attachment and sealing methods are described in U.S. patent application Ser. No. 10/462,472 of Marvin Glenn Wong et al., filed Jun. 16, 2003 and entitled "Fluid-Based Switches and Methods for Producing the Same", which is also incorporated by reference for all that it discloses.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

What is claimed is:

1. A method comprising:

depositing a first alignment pad on a first substrate;

depositing a second alignment pad on a second substrate;

forming a perimeter trench around at least one of the first alignment pad or second alignment pad;

depositing solder on at least one of the first alignment pad and the second alignment pad;

depositing a switching fluid on the first substrate; and mating the first substrate to the second substrate by aligning the first and second alignment pads and heating the solder, the first substrate and the second substrate defining there between a cavity holding the switching fluid, the cavity being sized to allow movement of the switching fluid between first and second states.

2. The method of claim 1, further comprising, after mating, hermetically sealing the first substrate to the second substrate.

3. The method of claim 2, wherein hermetically sealing comprises:

forming a perimeter ring around the first substrate and the second substrate, the perimeter ring being formed where the first substrate and the second substrate mate together;

depositing a wettable seal ring in the perimeter ring;

dispensing a solder paste with uncured epoxy flux on at least one of the first and second substrates; and heating the solder paste.

4. The method of claim 3, wherein the solder has a higher-melting point than the solder paste.

5. The method of claim 1, further comprising:

before mating, forming a perimeter ring in at least one of the first substrate and the second substrate, depositing a first seal ring on at least a portion of the perimeter ring and depositing a second seal ring on at least a portion of the perimeter of the other substrate; and after mating, soldering the first seal ring to the second seal ring.

6. The method of claim 1, further comprising before mating, optically smoothing a surface of the first substrate that is to be mated to the second substrate, and optically smoothing a surface of the second substrate that is to be mated to the first substrate.

7. The method of claim 6, wherein optically smoothing the first substrate and smoothing the second substrate comprises one of lapping, polishing, and chemical mechanical polishing.

8. A switch comprising:

first and second mated substrates, each substrate including at least one alignment pad, wherein at least one alignment pad includes a perimeter trench there around, the alignment pads soldered together, the first and second substrates defining there between at least portions of a number of cavities;

a plurality of electrodes exposed within one or more of the cavities;

a switching fluid, held within one or more of the cavities, that serves to open and close at least a pair of the plurality of electrodes in response to forces that are applied to the switching fluid; and an actuating fluid, held within one or more of the cavities, that applies the forces to said switching fluid.

9. The switch of claim 8, wherein the first substrate and the second substrate are hermetically sealed.

10. The switch of claim 9, further comprising a perimeter ring formed in at least one of the first and second substrates, a first seal ring deposited on at least a portion of the perimeter of the first substrate, a second seal ring deposited on at least a portion of the perimeter of the second substrate, solder joining the seal rings and epoxy flux between the solder and the first and second substrates.

11. the switch of claim 10, further comprising epoxy flux surrounding at least a portion of the solder.

12. A switch comprising:

first and second mated substrates, each substrate including at least one alignment pad, at least one alignment pad including a perimeter trench ring, the alignment pads soldered together, the first and second substrates defining there between at least portions of a number of cavities;

a plurality of wettable pads exposed within one or more of the cavities;

a switching fluid, wettable to said pads and held within one or more of the cavities, that serves to open and block light paths through one or more of the cavities in response to forces that are applied to the switching fluid; and an actuating fluid, held within one or more of the cavities, that applies the forces to said switching fluid.

13. The switch of claim 12, wherein the first substrate and the second substrate are hermetically sealed.

14. The switch of claim 12, further comprising a perimeter ring formed in at least one of the first and second substrates, a first seal ring deposited on at least a portion of the perimeter of the first substrate, a second seal ring deposited on at least a portion of the perimeter of the second substrate, solder joining the seal rings, epoxy flux between any solder and the first and second substrates any place there is not a first or second seal ring.

15. The switch of claim 14, further comprising epoxy flux surrounding at least a portion of the solder.

* * * * *

UNITED STATES PATENT AND TRADEMARK OFFICE

CERTIFICATE OF CORRECTION

PATENT NO. : 6,884,951 B1
APPLICATION NO. : 10/696641
DATED : April 26, 2005
INVENTOR(S) : Wong It is certified that error appears in the above-identified patent and that said Letters Patent is hereby corrected as shown below:

On the face page, in field (75), under "Inventor", in column 1, line 1, delete "Woodland Park," and insert -- Loveland, --, therefor.

In column 8, line 4, in Claim 11, delete "the" and insert -- The --, therefor.

Signed and Sealed this

Fourteenth Day of November, 2006

JON W. DUDAS
*Director of the United States Patent and Trademark Office*